US006435976B1

(12) United States Patent
Galliers

(10) Patent No.: US 6,435,976 B1
(45) Date of Patent: Aug. 20, 2002

(54) PUTTER

(76) Inventor: Gary E. Galliers, P.O. Box 700195, Plymouth, MI (US) 48170

( * ) Notice: Subject to any disclaimer, the term of this patent is extended or adjusted under 35 U.S.C. 154(b) by 0 days.

(21) Appl. No.: 09/785,137

(22) Filed: Feb. 20, 2001

(51) Int. Cl.[7] ..... A63B 69/36; A63B 53/02; A63B 53/04

(52) U.S. Cl. ..... 473/244; 473/248; 473/251; 473/313; 473/341; 473/314

(58) Field of Search ..... 473/244, 246, 473/247, 248, 251, 252, 305, 307, 312, 313, 314, 340, 341; 403/83–108

(56) References Cited

U.S. PATENT DOCUMENTS 4,519,612 A 5/1985 Tsao
4,735,414 A * 4/1988 Williams
4,815,740 A 3/1989 Williams
5,308,063 A * 5/1994 Vendur
5,390,919 A 2/1995 Stubbs et al.
5,462,279 A 10/1995 Culpepper
5,716,287 A 2/1998 Levocz et al.

* cited by examiner

*Primary Examiner*—Sebastiano Passaniti
(74) *Attorney, Agent, or Firm*—Charles W. Chandler

(57) ABSTRACT

A golf putter providing an adjustable angle between the shaft the putter head, which angle can be adjusted to accommodate individual golfers. The putter head has a slot which extends vertically from a lower surface thereof and a cylindrical recess which extends from a rear surface of the putter head forming a vertical wall therebetween, with a pair of arcuate-shaped slots. The putter further includes a hosel assembly having a cylindrical joint member affixed to the lower portion of the shaft. The joint member closely fits within the cylindrical recess forming a pivot which is lockable in the desired angular position by a pair of hex head screws which extend through the joint member and opposite portions of the arcuate-shaped slots into threaded holes of the lock member.

28 Claims, 5 Drawing Sheets

PUTTER

BACKGROUND OF THE INVENTION

1. Field

Figure 1:
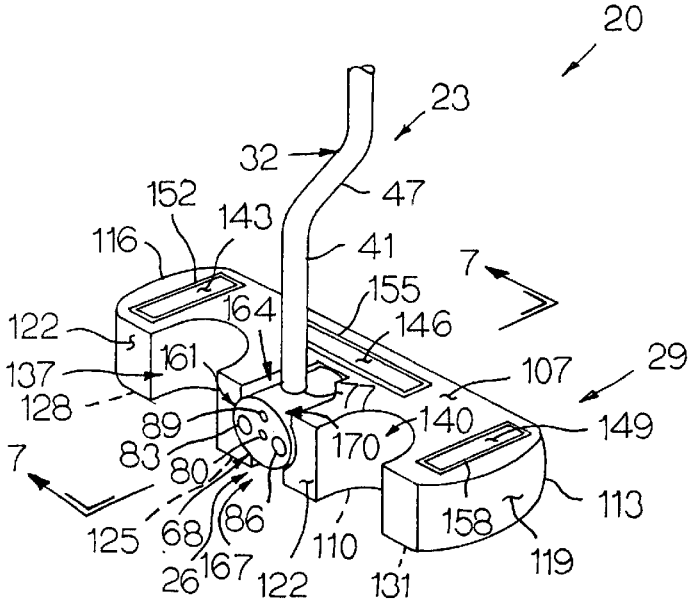

The invention relates to golf putters, and more particularly to golf putters in which the angle of the putting head can be changed relative to the shaft and hosel to customize the putter for the individual golfer.

2. State of the Art

U.S. Pat. No. 4,815,740 issued to Williams et al. disclosed an adjustable putter wherein the shaft and hosel may be connected to the putter head at a finite number of angular positions. This is accomplished by using a hosel having a hole perpendicular to the shaft, surrounded by a radial array of serrated teeth, and using a putter head having a journal surrounded by a mating radial array of serrated teeth. The hosel pivots on the journal and locked in place at a finite number of angular positions relative to the putter head, using a knob having a cap and a threaded stud which screws into a mating threaded hole in the journal. A compression spring disposed between the cap and the hosel urges the hosel into engagement with the putter head, locking the shaft and hosel into a fixed angular position relative to the putter head.

U.S. Pat. No. 5,716,287 issued to Levocz et al. disclosed an adjustable golf putter wherein the shaft and hosel may be connected to the putter head at a finite number of angular positions by an adapter plate and screws. The adapter plate includes a central hole to receive a screw and a plurality of smaller holes circularly disposed thereabout which mate with a pair of corresponding pins which extend, respectively, from the hosel and from the rear of the putter head. A screw extends into a hole through the hosel perpendicular to the shaft, through the adapter plate, and threads into the rear of the putter head. The adapter plate is sandwiched with the pins extending into respective holes in the plate to lock the shaft and hosel in a fixed angular position relative to the putter head. The angular position is adjusted depending on which set of holes is used.

U.S. Pat. No. 5,390,919 issued to Stubbs et al. disclosed an adjustable golf putter wherein the shaft and hosel are connected to the putter head in a finite number of angular positions and in a plurality of longitudinal positions along the putter head. The hosel includes a center hole, which extends perpendicular to the shaft for receiving a screw. A rectangular block includes a center hole to receive the screw and a plurality of holes corresponding to the hole in the hosel. The block fits within a recess extending along the top rear portion of the putter head for part of the distance between the toe and the heel, with a front wall which includes a plurality of threaded holes for receiving the screw, and a plurality of smaller holes corresponding to the holes in the hosel and the block. The hosel is connected to the putter head by a screw which extends through the hosel and the block into one of the threaded holes, with a plurality of pins fitting into the respective smaller holes therebetween to maintain the desired angular position of the shaft and hosel to the putter head. The block is reversible to provide additional angular positions.

U.S. Pat. No. 4,519,612 issued to Tsao disclosed a golf putter having a sighting prism positioned on the putter head. One version of the putter includes a shaft and hosel, which are connected to the putter head in an infinite number of angular positions. The hosel includes a stub shaft, which extends perpendicular to the putter shaft into a bore in the rear of the putter head. A thumb screw threads into a threaded hole in the top of the putter head. The end of the thumb screw bears against the stub shaft to lock the putter shaft and the hosel relative to the putter head in a desired angular position.

U.S. Pat. No. 5,462,279 issued to Culpepper disclosed a golf putter having a shaft and hosel which are connected to the putter head in an infinite number of angular positions. The hosel includes a bore, which extends perpendicularly to the shaft and has a tapered socket. The putter head includes a longitudinal recess which extends along the top rear portion of the putter head part of the distance between the toe and heel with a front wall having a tapered journal which extends rearwardly into the recess. An angular stop also extends rearwardly from the front wall above the tapered pin. The tapered socket of the hosel mates with the tapered journal, with a one-way screw which extends through the bore and threads into a threaded hole in the end of the tapered journal. A roll pin is inserted into a hole drilled through the hosel into the tapered journal following assembly at the desired angle to further prevent changing the angle of the shaft and hosel relative to the putter head during play to meet United States Golf Association rules for tournament play.

SUMMARY OF THE INVENTION

The invention is a golf putter wherein the angle between the shaft and hosel to the putter head is infinitely adjustable through a predetermined range of angles to accommodate the preference and build of individual golfers. The golf putter comprises a shaft assembly, an elongate, rounded, generally rectangular putter head, and a hosel assembly. The shaft assembly includes a shaft having a resilient grip affixed about the upper portion of the shaft.

The putter head includes respective upper and lower surfaces, a front putting surface, a rear surface, and respective heel and toe ends. A slot extends vertically from at least one of the upper and lower surfaces, a portion of the distance between the heel and toe ends, to define a longitudinally extending lock wall. Two arcuate lock wall slots extend through the lock wall.

The hosel assembly comprises a joint member, which is affixed to the lower portion of the shaft, a lock member having threaded holes, two hex head Allen screws, and a predrilled hosel hole for permanent locking. The joint member includes screw holes, which extend generally perpendicular to the shaft. The joint member is connected to the putter head by hex head Allen screws, which extend through the screw holes, through the lock wall arcuate slots, and which engage the threaded holes of the lock member. The shaft and joint member are locked at a desired angle by tightening the screws.

In a first embodiment of the putter, the lock wall hole has a pair of coaxial arcuate slots. The joint member includes a pair of screw holes, which extend generally perpendicular to the shaft and are spaced to correspond with the arcuate slots. The lock member includes a pair of threaded holes which correspond with the arcuate slots and the screw holes. The joint member is connected to the rear portion of the putter head by a pair of screws which extend through the screw holes, through the arcuate slots of the lock wall, and engage the threaded holes of the lock member. The joint member is rotatable with the screws traveling along the arcuate slots and locked at a desired angle by tightening the screws.

In the preferred embodiment, the putter head includes a generally cylindrical recess. The lock wall holes comprises arcuate slots, which extend through the lock wall to the recess. The joint member is generally cylindrical with the shaft extending through the longitudinal centerline thereof. The screw holes are radially offset from the longitudinal centerline and disposed to correspond with the arcuate slots. The joint member is connected to the putter head by screws, which extend through the screw holes, through the arcuate slots of the lock wall, and engages the threaded holes of the lock member. The joint member is rotated with the screws traveling along the arcuate slots, and locked at a desired angle by tightening the screws.

The preferred putter can further include features of the first embodiment putter wherein a single coaxial arcuate slot extends longitudinally through the transverse wall of the putter head. This requires a single hole, which extends longitudinally through the joint member, a single threaded hole, which extends through the lock member, and a single screw. The joint member is disposed in the cylindrical recess with the screw providing less stability to the connection than the first embodiment.

In any of the embodiments of the putter, the joint member is preferably connected on the rear portion of the putter head, between the heel and toe ends so as to be center-shafted. The lower portion of the shaft is offset toward the rear portion of the putter head to form a visual gate facilitating visual alignment of the putter head during putting. Such visual alignment can be further enhanced by the top surface of the putter head including one or more alignment markers for visually aligning putts.

For tournament play, the joint member can include a lock pin hole for accommodating a locking spring pin which extends into a hole drilled in the putter head to retain a desired angle between the joint member and the putter head.

The arcuate slots limit the angular rotational relationship of the putter head relative to the joint member and the shaft to a predetermined range of angular adjustment.

A second arcuate slot, extends through the lock wall, positioned to permit opposite-handed positioning of the shaft for accommodating opposite-handed golfers.

THE DRAWINGS

Figure 2:
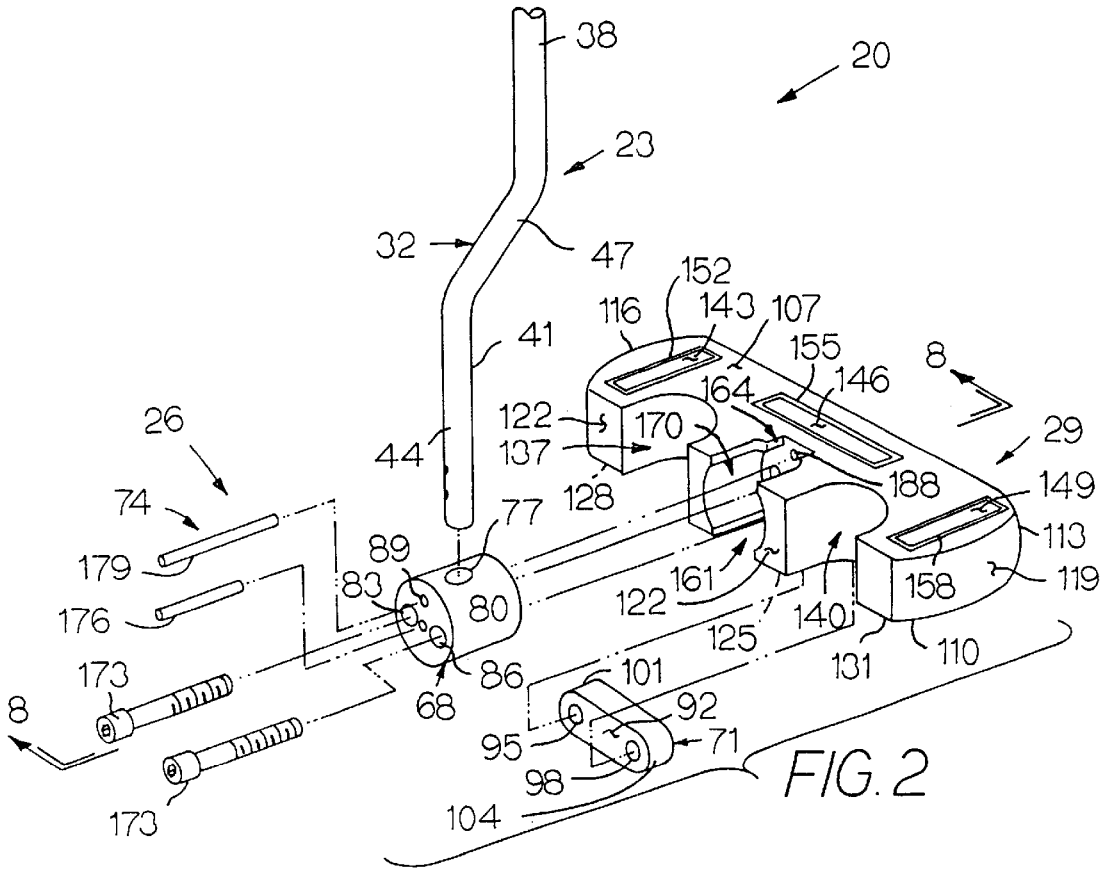
Figure 4:
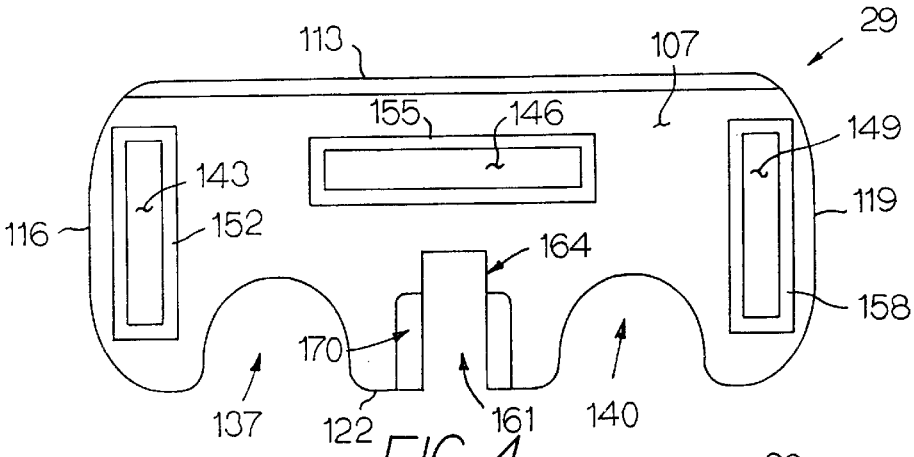
Figure 3:
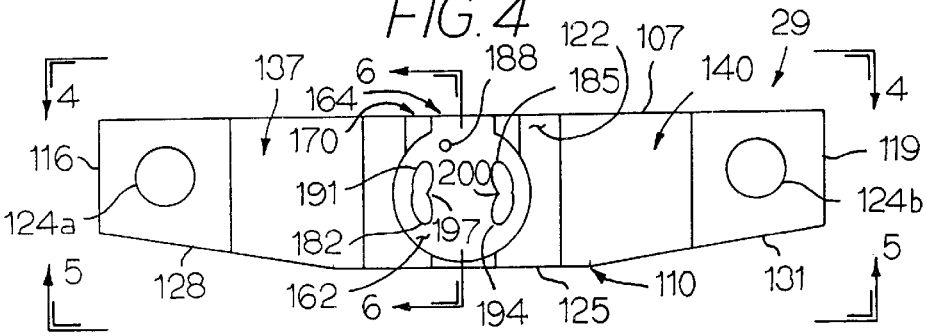
Figure 5:
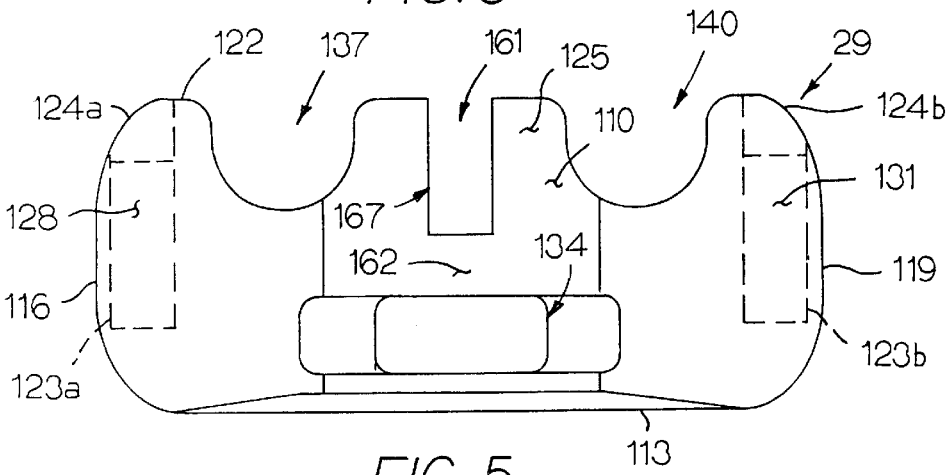
Figure 6:
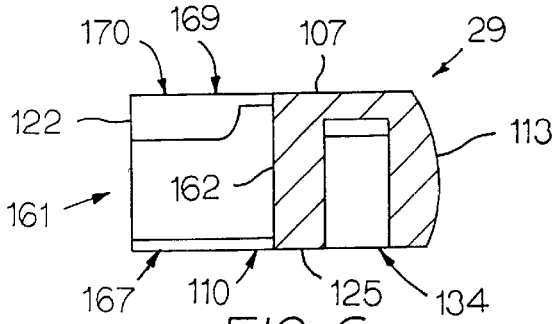
Figure 7:
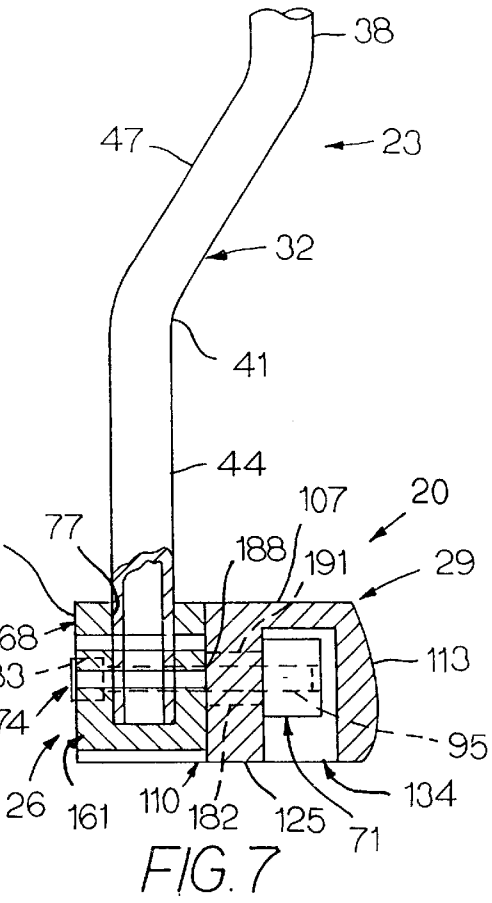
Figure 8:
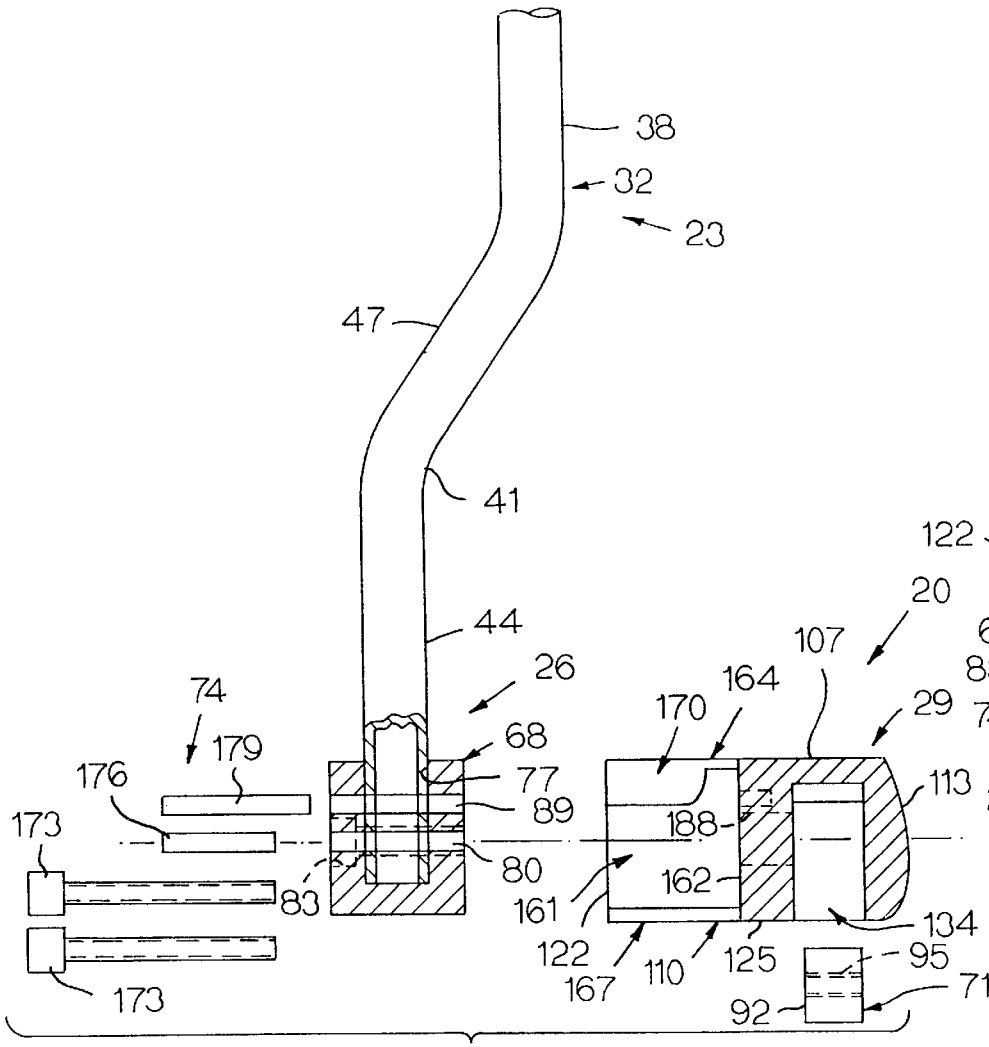
Figure 9:
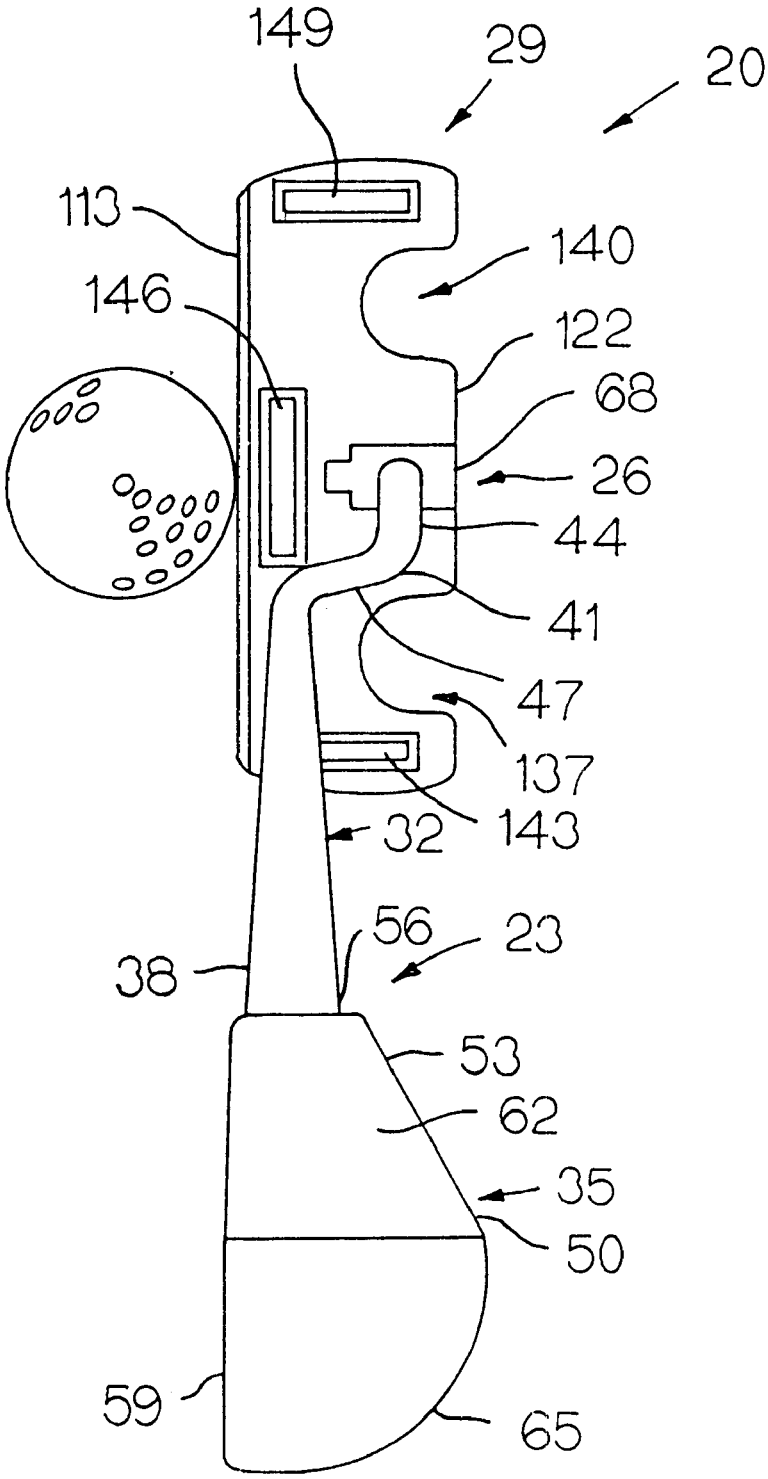
Figure 10:
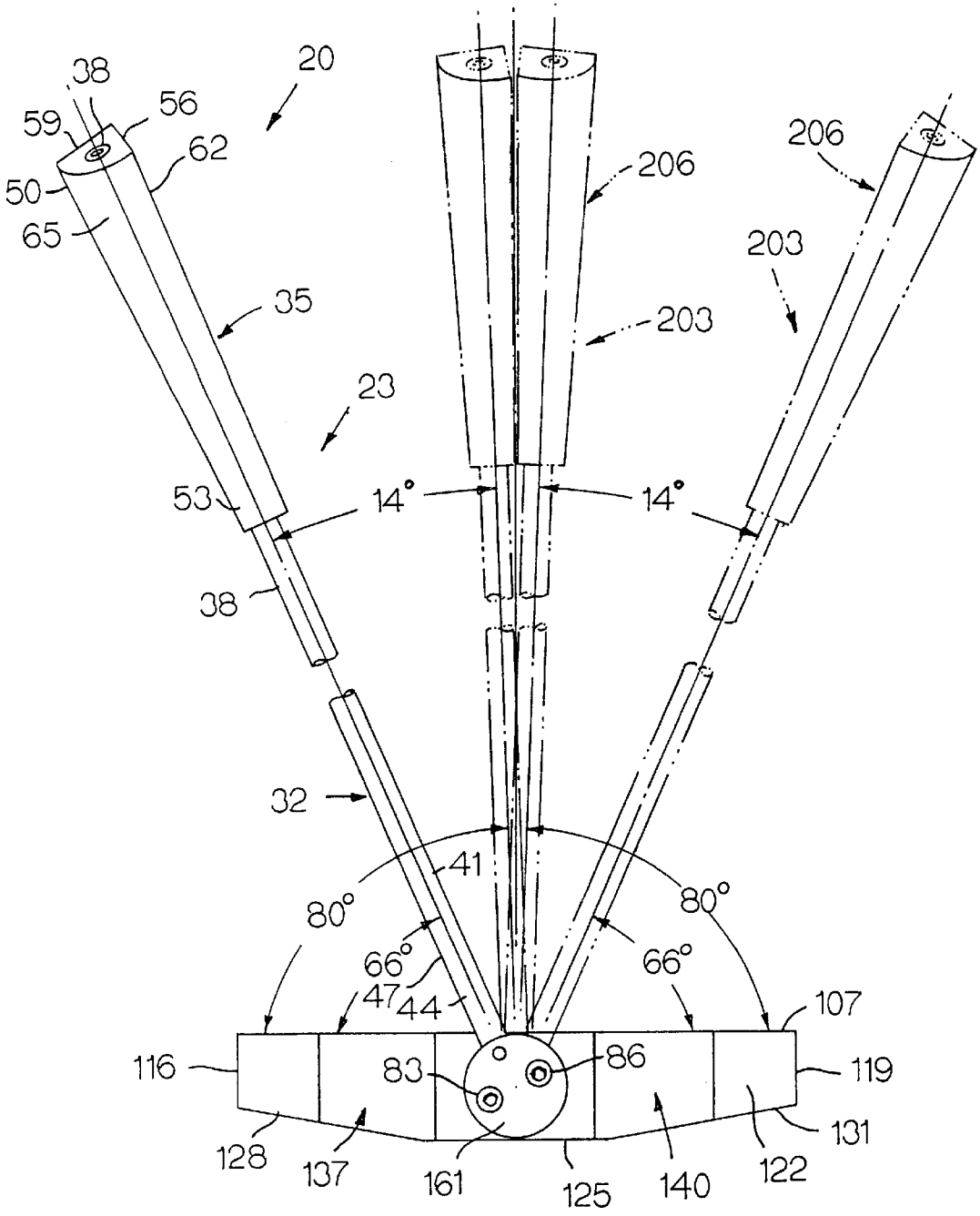

The best mode presently contemplated for carrying out the invention is illustrated in the accompanying drawings, in which:

FIG. 1 is a fragmentary rear perspective view of a golf putter illustrating the invention;

FIG. 2, an exploded fragmentary rear perspective view corresponding to FIG. 1, showing the individual components of the golf putter;

FIG. 3, a rear elevational view of the putter head showing the arcuate slots for accommodating left or right-handed golfers;

FIG. 4, a top plan view of the putter head taken on lines 4—4 of FIG. 3, showing the putt alignment markings;

FIG. 5, a bottom plan view of the putter head taken on lines 5—5 of FIG. 3, showing the lock member slot and lock wall;

FIG. 6, a lateral vertical sectional view taken on line 6—6 of FIG. 3, showing the rear recess, the lock member slot, and the lock wall;

FIG. 7, a fragmentary lateral vertical sectional view taken on line 7—7 of FIG. 1 showing the assembled putter;

FIG. 8, a fragmentary lateral vertical sectional view taken on line 8—8 of FIG. 2 showing the individual components of the putter;

FIG. 9, a top perspective view of the putter showing the visual gate for viewing the putt alignment markings; and FIG. 10 a rear elevational view of the putter showing the various angular positions of the shaft in the right and left-handed positions, and showing the left-handed grip.

DETAILED DESCRIPTION OF THE PREFERRED EMBODIMENTS

FIGS. 1, 2, and 9 illustrate a golf putter 20, illustrating the invention, which comprises a shaft assembly 23, a pivoting hosel assembly 26, and a putter head 29. Shaft assembly 23 includes a longitudinally tapered shaft 32 and an elongate grip 35. Shaft 32 includes a generally straight upper shaft 38 and an integral offset lower shaft 41 comprising end portion 44 which is parallel and connected to upper shaft 38 by an angled portion 47. Shaft 32 is made of any of the standard materials known in the golf club industry such as steel, aluminum, or composites.

Referring to FIG. 10, grip 35 has a generally quarter-pie shape cross-section, tapering from a larger closed upper end 50 to a smaller open lower end 53. Grip 35 includes a pair of respective flat sides 59 and 62, and an arcuate side 65. Grip 35 provides a secure grip by conforming to the golfer's hands while allowing precise aiming and a smooth putting stroke. Other grips having a single flat, or completely round cross-section are available at the discretion of the individual user.

Referring to FIG. 2, hosel assembly 26 comprises a cylindrical joint member 68, a threaded lock member 71, and hardware 74. Joint member 68 has a lateral shaft bore 77 which extends through most of the diameter of joint member 68, a longitudinal shaft pinning hole 80, a pair of respective longitudinal counterbored screw holes 83 and 86, and a longitudinal hosel angle pinning hole 89. Shaft bore 77, shaft pinning hole 80, and pinning hole 89 can also be adhesively bonded, or otherwise secured for improved strength, particularly when shaft 32 and joint member 68 are constructed of polymer or composite materials.

Lock member 71 includes a flat front side 92, a pair of threaded parallel, screw-receiving holes 95 and 98 perpendicular to front side 92, and respective rounded ends 101 and 104. Screw-receiving holes 95 and 98 can have a threaded metal insert (not shown) adhesively bonded or otherwise secured therein, or helicoils for improved strip resistance and strength, particularly when lock member 71 is constructed of polymer or composite materials.

As best shown in FIGS. 3–6 and 10, putter head 29 is a single piece of machined or molded polymer, a metal such as aluminum or stainless steel, or a composite material of rounded, generally rectangular shape, having a flat upper surface 107, an upwardly angled lower surface 110, a radiused golf ball contacting front surface 113, respective horizontally rounded left and right sides 116 and 119, and a vertical rear surface 122. Lower surface 110 includes a horizontal central portion 125 and respective upwardly angled left and right side portions 128 and 131. A lock member-receiving slot 134 extends from central portion 125, being adjacent and parallel to front surface 113. A pair of respective weight-reducing left and right rear cutouts 137 and 140 extends inwardly into putter head 29, providing a curved configuration for rear surface 122.

Referring to FIGS. 3 and 5, a pair of cylindrical, metal weights **123*a* and 123*b* are embedded in the ends of the putter head, and covered by plugs 124*a* and 124*b***, respectively.

Putt aligning indicia in the form of respective heel, center, and toe rectangular markers 143, 146 and 149 are adhesively secured to upper surface 107. The markers are surrounded by respective heel, center, and toe marker alignment grooves 152, 155, and 158, molded or machined into upper surface 107 to aid in aligning markers 143,146, and 149 at putter assembly.

A cylindrical recess 161 extends inwardly into putter head 29 from rear surface 122 between cutouts 137 and 140 to form a lateral lock wall 162. Recess 161 is sized to closely receive joint member 68 for rotation through a range of angular adjustments. Joint member 68 has the same outer diameter as the thickness of putter head 29 such that recess 161 breaks through upper surface 107 and central portion 125 of lower surface 110 at respective upper and lower slots 164 and 167. Upper slot 164 has an enlarged portion 170 for clearing offset lower shaft 41 of shaft 32.

Referring to FIGS. 7 and 8, shaft 32, cylindrical joint member 68, and lock member 71 are connected to putter head 29 using hardware 74. Hardware 74 comprises a pair of hex head screws 173, a shaft retaining spring pin 176 and a locking spring pin 179. Pin 176 is slightly shorter than joint member 68. Pin 179 is longer than joint member 68. End portion 44 of shaft 32 closely fits within shaft bore 77, retained therein by means of adhesive bonding and pin 176 which is press fit within shaft pinning hole 80 through shaft portion 44. Screws 173 extend through respective screw holes 83 and 86 of joint member 68, and through respective coaxial arcuate slots 182 and 185, best shown in FIG. 3.

As shown in FIG. 2, screws 173 thread into screw-receiving holes 95 and 98 of lock member 71 which is disposed in slot 134 of the putter head. Slots 182 and 185 allow joint member 68 and the shaft to be rotated to a desired angular position. Screws 173 are tightened to pull joint member 68 and lock member 71 against lock wall 162.

Joint member 68 can be pinned in position, to meet the rules of the United States Golf Association of non-adjustability for tournament play, by further drilling pinning hole 89 into lock wall 162 forming a retaining hole 188. Spring pin 179 is press fitted into hole 188 connecting joint member 68 to lock wall 162.

As best shown in FIG. 3, a second pair of coaxial arcuate slots 191 and 194 in lock wall 162 slightly overlaps arcuate slots 182 and 185 at necked-down central portions 197 and 200. Slots 191 and 194 have a width chosen to restrict screws 173 from passing therebetween, to allow opposite-handed golfers to use golf putter 20. Referring to FIG. 10, an opposite-handed shaft assembly 203 comprising tapered shaft 32 and an elongate grip 206, which is a mirror image of grip 35 in cross-section, is then employed.

Many variations of the golf putter are possible while staying within the same inventive concept. For example, while the holes through the lock member are preferably threaded, separate nuts can be used in conjunction with or which replace the lock member.

Whereas this invention is illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the following claims.

Having described my invention, I claim:

1. A golf putter, comprising:

a shaft assembly having an elongate shaft with an upper portion and a lower portion, and an elongate resilient grip affixed about said upper portion;

an elongate putter head having respective upper and lower surfaces, a front radiused putting surface, a rear surface, and respective heel and toe ends, an elongate slot extending vertically from at least one of said upper and lower surfaces between said putting surface and a rear portion of said putter head defining a longitudinally extending lock wall, having a lock wall hole;

a hosel assembly comprising a rotatable joint member affixed to said lower portion of said shaft, said joint member having a screw hole which extends generally perpendicular to said shaft and aligned with said lock wall hole, said hosel assembly further comprising a lock member having a threaded hole therethrough aligned with said lock wall hole and said screw hole;

a screw; and wherein said joint member is connectable to a rear portion of said putter head by means of said screw which extends through said screw hole thereof, and said lock wall hole, and threadably engages said threaded hole of said lock member, and wherein said joint member is rotatable through an angular range and lockable at a desired angle by tightening said screw.

2. A golf putter according to claim 1, wherein the lock wall hole comprises an arcuate slot which extends through the lock wall, the joint member includes a screw hole which extends generally perpendicular to the shaft and spaced so as to be aligned with said arcuate slot, the lock member including a threaded hole therethrough which is aligned with said arcuate slot and said screw hole; and including a screw, and wherein said joint member is connectable to the rear portion of the putter head by means of said screw which extends through said screw hole, said arcuate slot of said lock wall, and threadably engages said threaded hole of said lock member, and wherein said joint member is rotatable through an angular range determined by said screw sliding along said arcuate slot and lockable at a desired angle by tightening said screw.

3. A golf putter according to claim 2, wherein the joint member is connectable at a position on the rear portion of the putter head substantially longitudinally centered between the heel and toe ends thereof so as to be center-shafted, and wherein the lower portion of the shaft is offset toward said rear portion of said putter head, said lower portion of said shaft forming a visual gate adjacent the upper surface of said putter head to facilitate visual alignment of said putter head during putting.

4. A golf putter according to claim 3, wherein the top surface of the putter head includes at least one alignment marker for visually aligning putts.

5. A golf putter according to claim 3, wherein the lower surface of the putter head is tapered comprising a central portion which extends laterally from the front putting surface to the rear surface and longitudinally between the toe and heel ends a portion of the distance therebetween, and respective upwardly angled left and right side portions which connect respective ends of said central portion to said toe and heel ends of said putter head.

6. A golf putter according to claim 2, wherein a lock pin hole extends longitudinally through the joint member for accommodating an angle locking spring pin to retain a desired angle between said joint member and said putter head.

7. A golf putter according to claim 2, wherein the arcuate slot functions to limit the angular rotational relationship of the putter head relative to the shaft to a predetermined range of angular adjustment.

8. A golf putter according to claim 7, wherein a second arcuate slot extends through the lock wall positioned to permit opposite-handed positioning of the shaft through a predetermined range of angular motion for opposite-handed golfers.

9. A golf putter according to claim 8, wherein the first and second arcuate slots are coaxial and have substantially the same radius, being disposed so as to partially overlap to form a pair of arcuate shaped slots having a central portion sufficiently narrow to prohibit sliding of the respective screws thereacross from one of said pairs of slots to the other.

10. A golf putter according to claim 9, wherein the respective arcuate-shaped slots limit the range of angular motion of the putter head relative to the joint member to a predetermined angular range of between about sixty-six degrees and eighty degrees from the bottom surface of said putter head adjacent said joint member.

11. A golf putter according to claim 2, further comprising:

a shaft retaining spring pin; and wherein the joint member includes a shaft bore into the lower portion of the shaft and a shaft pin hole which extends into said joint member generally perpendicular to and through said lower portion of said shaft, and wherein said shaft retaining spring pin extends through said shaft pin hole to retain said shaft to said joint member.

12. A golf putter according to claim 11, wherein a lock pin hole extends longitudinally through the joint member for accommodating an angle locking spring pin insertable thereinto so as to extend into an angle retaining hole coaxially drilled into the putter head, with said joint member positioned at a desired angle in the predetermined range of angular motion between said joint member and said putter head, said lock pin hole extending through the lower portion of said shaft to permit an angle locking spring pin inserted thereinto.

13. A golf putter according to claim 1, wherein the putter head includes a cylindrical recess extending laterally inwardly from the rear portion thereof and configured to mate with the joint member, the lock wall hole comprising an arcuate slot which extend through the lock wall to said recess, the joint member being generally cylindrical with the screw bolt hole, therethrough being radially offset from a longitudinal centerline of said joint member and being aligned with said arcuate slot the threaded hole of the lock member being aligned with said arcuate slot and said screw hole, wherein said joint member is connectable to a rear portion of said putter head by means of said screws engaging said threaded hole of said lock member, and wherein said joint member is rotatable through an angular range determined by screw sliding along said arcuate slot and lockable at a desired angle by tightening said screw.

14. A golf putter according to claim 13, wherein the joint member is connectable at a position on the rear portion of the putter head substantially longitudinally centered between the heel and toe ends thereof so as to be center-shafted, and wherein the lower portion of the shaft is offset toward said rear portion of said putter head, to form a visual gate adjacent the upper surface of said putter head to facilitate visual alignment of said putter head during putting.

15. A golf putter according to claim 14, wherein the top surface of the putter head includes at least one alignment marker for visually aligning a putt.

16. A golf putter according to claim 14, wherein the lower surface of the putter head is tapered comprising a central portion which extends laterally from the front putting surface to the rear surface and longitudinally between the toe and heel ends a portion of the distance therebetween, and respective upwardly angled left and right side portions which connect respective ends of said central portion to said toe and heel ends of said putter head.

17. A golf putter according to claim 14, including a pair of coaxial arcuate slots which extend longitudinally through the transverse wall of the putter head, a pair of spaced holes which extend longitudinally through the hosel assembly, a pair of threaded holes extending through the lock member, and a pair of screws.

18. A golf putter according to claim 17, wherein the arcuate slots function to limit the angular rotational relationship of the putter head relative to the joint member and the shaft to a predetermined range of angular adjustment.

19. A golf putter according to claim 18, including a second pair of coaxial arcuate slots extending through the lock wall to permit opposite-handed positioning of the shaft through a predetermined range of angular adjustment for opposite-handed golfers.

20. A golf putter according to claim 19, wherein the first and second pairs of arcuate slots are coaxial and have substantially the same radius, and are disposed to partially overlap to form a pair of arcuate-shaped slots having a central portion sufficiently narrow to prohibit sliding of the screws from one of said pairs of slots to the other.

21. A golf putter according to claim 20, wherein the respective arcuate-shaped slots limit the range of angular motion of the putter head relative to the joint member to a predetermined angular range of between about sixty-six degrees and eighty degrees from the bottom surface of said putter head adjacent said joint member.

22. A golf putter according to claim 13, wherein a lock pin hole extends longitudinally through the joint member for accommodating an angle locking spring pin; and an angle retaining hole drilled in the putter head to retain a desired angle between said joint member and said putter head.

23. A golf putter according to claim 13, wherein the arcuate slot functions to limit the angular rotational relationship of the putter head relative to the joint member and the shaft to a predetermined range of angular motion.

24. A golf putter according to claim 23, including a second arcuate slot extending through the lock wall and positioned to permit opposite-handed positioning of the shaft through a predetermined range of angular motion for opposite-handed golfers.

25. A golf putter according to claim 24, wherein the first and second arcuate slots are coaxial and have substantially the same radius, and are disposed to partially overlap to comprise arcuate-shaped slots having a central portion sufficiently narrow to prohibit sliding of the screw from one of said slots to the other.

26. A golf putter according to claim 25, wherein the arcuate-shaped slot limits the range of angular motion of the putter head relative to the joint member to a predetermined angular range of between about sixty-six degrees and eighty degrees from the bottom surface of said putter head adjacent said joint member.

27. A golf putter according to claim 13, further comprising:

a shaft retaining spring pin; and wherein the joint member includes a shaft bore into the lower portion of the shaft, and a shaft pin hole which extends into said joint member generally perpendicular to and through said lower portion of said shaft, and wherein said shaft retaining spring pin extends through said shaft pin hole to retain said shaft to said joint member.

28. A golf putter according to claim 1, including a pair of plugs each of a selected weight carried adjacent opposite ends of the putter head.

* * * * *